US012366369B2

(12) United States Patent
McKay

(10) Patent No.: US 12,366,369 B2
(45) Date of Patent: Jul. 22, 2025

(54) SADDLE WINDOW AIR CONDITIONER WITH INCREASED AIR INTAKE

(71) Applicant: Haier US Appliance Solutions, Inc., Wilmington, DE (US)

(72) Inventor: Brian Bernard McKay, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 218 days.

(21) Appl. No.: 18/176,046

(22) Filed: Feb. 28, 2023

(65) Prior Publication Data

US 2024/0288181 A1 Aug. 29, 2024

(51) Int. Cl.
*F24F 1/027* (2019.01)
*F24F 1/028* (2019.01)
*F24F 1/0323* (2019.01)

(52) U.S. Cl.
CPC ..... *F24F 1/027* (2013.01); *F24F 1/028* (2019.02); *F24F 1/0323* (2019.02)

(58) Field of Classification Search
CPC .. F24F 1/07; F24F 1/028; F24F 1/0323; F24F 1/031
See application file for complete search history.

(56) References Cited

U.S. PATENT DOCUMENTS 5,167,131 A * 12/1992 Karkhanis ..... F24F 1/027 62/262
5,542,263 A * 8/1996 Choi ..... F24F 1/027 62/412
7,305,844 B2 12/2007 Cho et al.
8,155,797 B2 4/2012 Wiese
9,188,352 B2 11/2015 Wiese
9,927,138 B2 3/2018 Wiese
10,021,809 B2 7/2018 Lee et al.
10,101,042 B2 10/2018 Kim et al.
10,527,311 B2 1/2020 Seo et al.
10,935,257 B2 3/2021 Jung et al.
2004/0168461 A1* 9/2004 Park ..... F24F 1/027 62/262
2011/0039490 A1 12/2011 Wiese
2020/0400326 A1* 12/2020 Bailey ..... F24F 11/38
2021/0164669 A1 6/2021 Huang
2021/0222892 A1 7/2021 Battiese
2021/0262691 A1 8/2021 Jang et al.
2021/0341200 A1 11/2021 Yang et al.

FOREIGN PATENT DOCUMENTS

CN 108469075 A * 8/2018 ..... F24F 1/02
WO WO2016029532 A1 3/2016
WO WO2017084371 A1 5/2017
WO WO2018054042 A1 3/2018
(Continued)

*Primary Examiner* — Kun Kai Ma
(74) *Attorney, Agent, or Firm* — Dority & Manning, P.A.

(57) ABSTRACT

A saddle window air conditioner is provided, the saddle air conditioner comprising an indoor module and an outdoor module. The indoor module comprises a front-side air intake, a rear-side air intake, an indoor coil formed of a plurality of coil portions, and a fan configured to urge a flow of air over the indoor coil. Each of the plurality of coil portions of the indoor coil is arranged at a different angular orientation.

20 Claims, 4 Drawing Sheets

(56) References Cited

FOREIGN PATENT DOCUMENTS

| | | | | | |
|---|---|---|---|---|---|
| WO | WO2018233142 | A1 | | 12/2018 | |
| WO | WO2019109395 | A1 | | 6/2019 | |
| WO | WO2020207099 | A1 | | 10/2020 | |
| WO | WO2021042190 | A1 | | 3/2021 | |
| WO | WO2021134896 | A1 | | 7/2021 | |
| WO | WO2021134899 | A1 | | 7/2021 | |
| WO | WO2021134902 | A1 | | 7/2021 | |
| WO | WO2021134903 | A1 | | 7/2021 | |
| WO | WO2021134932 | A1 | | 7/2021 | |
| WO | WO2021135431 | A1 | | 7/2021 | |
| WO | WO-2021135575 | A1 | * | 7/2021 | |
| WO | WO2021135600 | A1 | | 7/2021 | |
| WO | WO-2021244097 | A1 | * | 12/2021 | ..... F24F 1/031 |

* cited by examiner

SADDLE WINDOW AIR CONDITIONER WITH INCREASED AIR INTAKE

FIELD OF THE INVENTION

The present subject matter relates generally to window air conditioners, more specifically to saddle window air conditioners.

BACKGROUND OF THE INVENTION

Saddle window air conditioners consist of an indoor module and an outdoor module connected with a bridge. The indoor module comprises an evaporator and a fan, among other things, while the outdoor module comprises a condenser, a compressor and a fan. The bridge is an enclosed structure connecting the two modules and providing a protected passage for electronic and fluid communication components between the modules.

Saddle window air conditioners allow a window to be freely opened and closed when the saddle window air conditioner is installed in the window. Thus, such air conditioners may be used to cool air within a home while also allowing the window to be opened to allow fresh air to enter the room. Saddle window air conditioners may also be quieter than other window air conditioners due to the placement of a fan and compressor outside of the cooled room.

However, saddle window air conditioners may be less efficient to operate than other window air conditioners due, in part, to limited surface area of the indoor coils. Increasing the surface area of the indoor coils may beneficially allow a greater air flow over the coils to increase efficiency and the cooling capacity of the air conditioner. Accordingly, improvements to increase the surface area of the indoor coils of a saddle air conditioner would be beneficial.

BRIEF DESCRIPTION OF THE INVENTION

Aspects and advantages of the invention will be set forth in part in the following description, may be apparent from the description, or may be learned through practice of the invention.

In one exemplary aspect a saddle window air conditioner defining a horizontal direction, a vertical direction, and a transverse direction is provided. The saddle window air conditioner comprises an indoor module and an outdoor module. The indoor module comprises a front-side air intake, a rear-side air intake, an indoor coil formed of a plurality of coil portions, and a fan configured to urge a flow of air over the indoor coils, wherein each of the plurality of coil portions is arranged at a different angular orientation.

In another example aspect, a saddle window air conditioner defining a horizontal direction, a vertical direction, and a transverse direction is provided, the saddle air conditioner comprising an indoor module and an outdoor module. The indoor module comprises a front-side air intake, a rear-side air intake, and indoor coil formed of a plurality of coil portions, each of the coil portions arranged at a different angular orientation, and an indoor fan. The outdoor module comprises an outdoor coil, a compressor, and a reversing valve, wherein the indoor coil is an evaporator whet the reversing valve is in a first position and the indoor coil is a condenser when the reversing valve is in a second position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
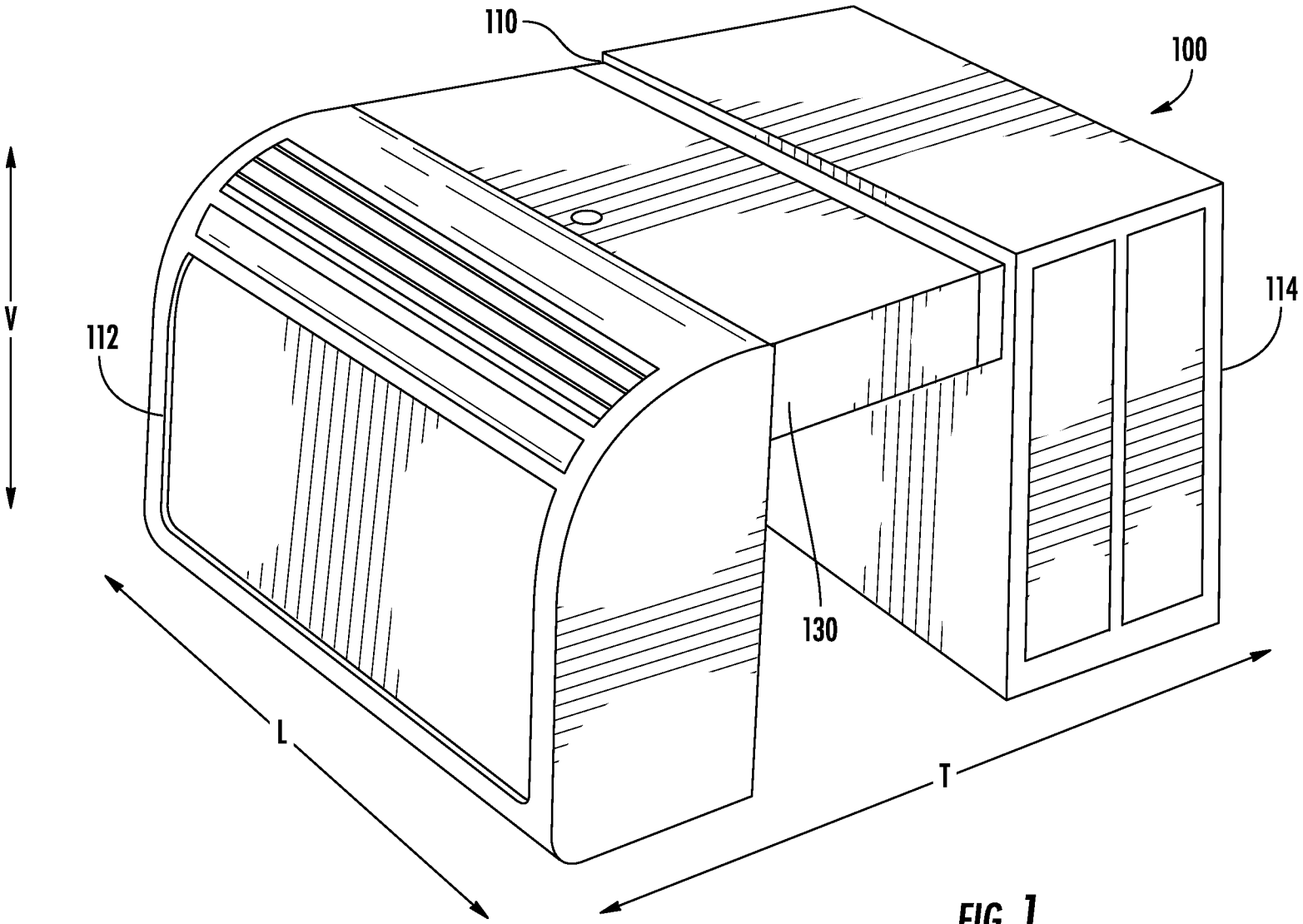
FIG. 1 provides a perspective view of a saddle window air conditioner according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

As used herein, "interior" and "indoor" when used to describe position, location, or atmosphere generally refer to that portion of a room or building into which conditioned air is provided to have a controlled effect on the environment. Generally, this is understood to be the inside of a room or an inside portion of a building that is protected from the elements, rather the outside portion that is generally exposed to the elements. Accordingly, an "indoor module" or "interior module" would refer to a module located in or used in a room or portion of a building in which the atmosphere is controlled.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
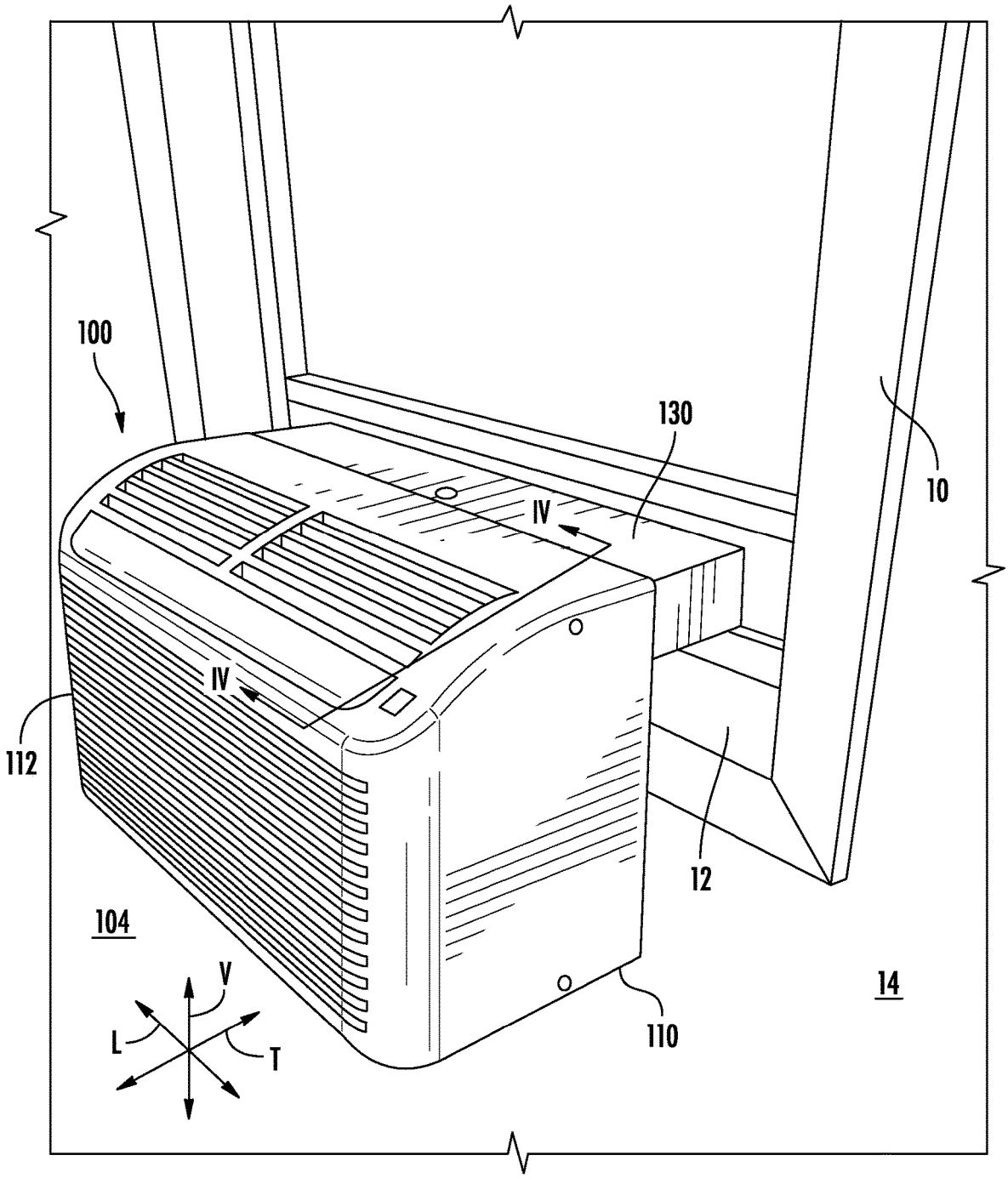
FIG. 2 provides an interior perspective of the example saddle window air conditioner of FIG. 1 installed in a window.

Turning to the figures, FIG. 1 provides perspective view of a saddle window air conditioner 100 according to an example embodiment of the present subject matter. FIG. 2 is an interior perspective of saddle window air conditioner 100 installed in a window 10. Saddle window air conditioner 100 is operable to generate chilled and/or heated air in order to regulate the temperature of an associated room or building (i.e., an interior space). As will be understood by those skilled in the art, saddle window air conditioner 100 may be installed within window 10 to cool and/or heat air on an interior side of window 10 to a selected temperature. As discussed in greater detail below, a sealed system 120 (FIG. 3) of saddle window air conditioner 100 is disposed within a saddle window air conditioner 100. Thus, saddle window air conditioner 100 may be a self-contained or autonomous system for heating and/or cooling air. Saddle window air conditioner 100 defines a vertical direction V, a lateral direction L and a transverse direction T that are mutually perpendicular and form an orthogonal direction system.

As used herein, the term "saddle window air conditioner" is used broadly. For example, saddle window air conditioner 100 may include a supplementary electric heater (not shown) for assisting with heating air within the associated room or building without operating the sealed system 120. However, as discussed in greater detail below, saddle window air conditioner 100 may also include a heat pump heating mode that utilizes sealed system 120, with or without an electric resistance heater, to heat air within the associated room or building. Thus, it should be understood that "saddle window air conditioner" as used herein is intended to cover both units with and without heat pump heating modes.

With reference to FIGS. 1 and 2, saddle window air conditioner 100 includes an indoor module 112, an outdoor module 114, and a bridge 130. Indoor module 112 and outdoor module 114 are spaced apart from each other, e.g., along the transverse direction T. Thus, indoor module 112 may be positioned at or contiguous with an interior atmosphere 104 on one side of window 10, and outdoor module 114 may be positioned at or contiguous with an exterior or outdoor atmosphere on the other side of window 10. Bridge 130 extends between indoor module 112 and outdoor module 114, e.g., through window 10, adjacent to sill 12.

Figure 3:
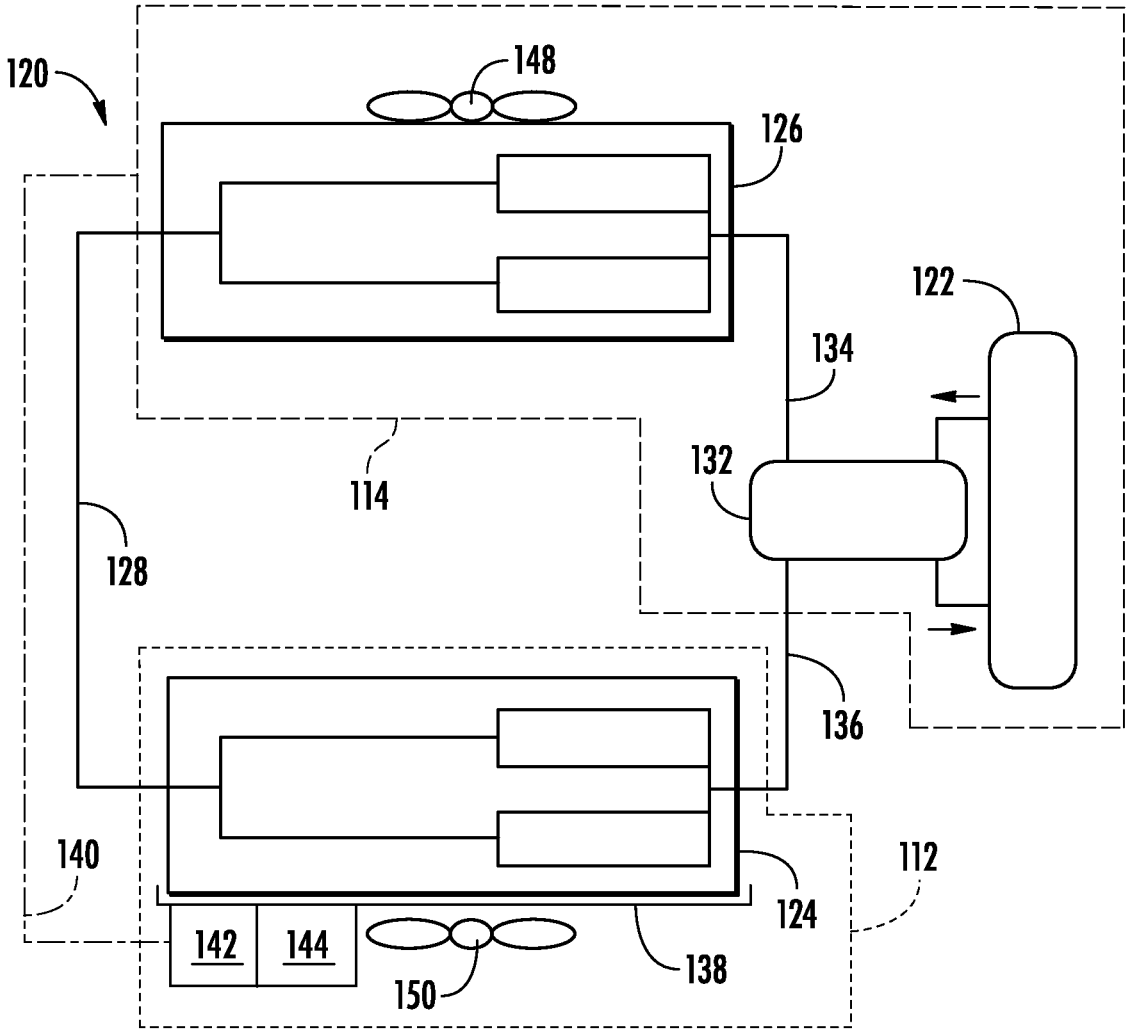
FIG. 3 provides a schematic view of a sealed system of the example saddle window air conditioner of FIG. 1.

Turning to FIG. 3, sealed system 120 is disposed or positioned within saddle window air conditioner 100, and sealed system 120 includes components for transferring heat between the exterior atmosphere and the interior atmosphere. In particular, various components of sealed system 120 are positioned within indoor module 112 while other components of sealed system 120 are positioned within outdoor module 114.

Saddle window air conditioner 100 further includes a controller (not shown) with user inputs, such as buttons, switches and/or dials. The controller regulates operation of saddle window air conditioner 100. Thus, the controller is in operative communication with various components of saddle window air conditioner 100, such as components of sealed system 120 and/or a temperature sensor, such as a thermistor or thermocouple, for measuring the temperature of the interior atmosphere 104. In particular, the controller may selectively activate sealed system 120 in order to chill or heat air within sealed system 120, e.g., in response to temperature measurements from the temperature sensor.

The controller includes memory and one or more processing devices such as microprocessors, CPUs or the like, such as general or special purpose microprocessors operable to execute programming instructions or micro-control code associated with operation of saddle window air conditioner 100. The memory can represent random access memory such as DRAM, or read only memory such as ROM or FLASH. The processor executes programming instructions stored in the memory. The memory can be a separate component from the processor or can be included onboard within the processor. Alternatively, the controller may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Sealed system 120 generally operates in a heat pump cycle. Sealed system 120 includes a compressor 122, an interior heat exchanger or indoor coil 124 and an exterior heat exchanger or outdoor coil 126. As is generally understood, various conduits may be utilized to flow refrigerant between the various components of sealed system 120. Thus, e.g., indoor coil 124 and outdoor coil 126 may be in fluid communication with each other and compressor 122.

As may be seen in FIG. 3, sealed system 120 may also include a reversing valve 132. Reversing valve 132 selectively directs compressed refrigerant from compressor 122 to either indoor coil 124 via conduit 136 or to outdoor coil 126 via conduit 134. For example, in a first or cooling mode, reversing valve 132 is arranged or configured to direct compressed refrigerant from compressor 122 to outdoor coil 126. In the cooling mode, outdoor coil 126 is a condenser and indoor coil 124 is an evaporator. Conversely, in a second or heating mode, reversing valve 132 is arranged or configured to direct compressed refrigerant from compressor 122 to indoor coil 124. Consequently, in the heating mode, indoor coil 124 is a condenser and outdoor coil 126 is the evaporator. Thus, reversing valve 132 permits sealed system 120 to adjust between the heating mode and the cooling mode, as will be understood by those skilled in the art.

During operation of sealed system 120 in the cooling mode, refrigerant flows from indoor coil 124 through compressor 122. For example, refrigerant may exit indoor coil 124 as a fluid in the form of a superheated vapor. Upon exiting indoor coil 124, the refrigerant may enter compressor 122. Compressor 122 is operable to compress the refrigerant. Accordingly, the pressure and temperature of the refrigerant may be increased in compressor 122 such that the refrigerant becomes a more superheated vapor.

Outdoor coil 126 is disposed downstream of compressor 122 in the cooling mode and acts as a condenser. Thus, outdoor coil 126 is operable to reject heat into the outdoor atmosphere at outdoor module 114 of saddle window air conditioner 100 when sealed system 120 is operating in the cooling mode. For example, the superheated vapor from compressor 122 may enter outdoor coil 126 via a first distribution conduit 134 that extends between and fluidly connects reversing valve 132 and outdoor coil 126. Within outdoor coil 126, the refrigerant from compressor 122 transfers energy to the outdoor atmosphere and condenses into a saturated liquid and/or liquid vapor mixture. An outdoor air handler or outdoor fan 148 is positioned adjacent outdoor coil 126 may facilitate or urge a flow of air from the exterior or outdoor atmosphere across outdoor coil 126 in order to facilitate heat transfer.

Sealed system 120 also includes a capillary tube 128 disposed between indoor coil 124 and outdoor coil 126, e.g., such that capillary tube 128 extends between and fluidly couples indoor coil 124 and outdoor coil 126. Refrigerant, which may be in the form of high liquid quality/saturated liquid vapor mixture, may exit outdoor coil 126 and travel through capillary tube 128 before flowing through indoor coil 124. Capillary tube 128 may generally expand the refrigerant, lowering the pressure and temperature thereof. The refrigerant may then be flowed through indoor coil 124.

Indoor coil 124 is disposed downstream of capillary tube 128 in the cooling mode and acts as an evaporator. Thus, indoor coil 124 is operable to heat refrigerant within indoor coil 124 with energy from the interior atmosphere 104 at indoor module 112 of saddle window air conditioner 100 when sealed system 120 is operating in the cooling mode. For example, the liquid or liquid vapor mixture refrigerant from capillary tube 128 may enter indoor coil 124 via a second distribution conduit 136 that extends between and fluidly connects indoor coil 124 and reversing valve 132. Within indoor coil 124, the refrigerant from capillary tube 128 receives energy from the indoor atmosphere 104 and vaporizes into a superheated vapor and/or high quality vapor mixture. An indoor air handler or indoor fan 150 is positioned adjacent indoor coil 124 and may facilitate or urge a flow of air from the interior atmosphere across 104 indoor coil 124 in order to facilitate heat transfer. Indoor fan may be any suitable fan configured to provide a required air flow to achieve the required heat transfer, for example, indoor fan may be a cross-flow fan.

During operation of sealed system 120 in the heating mode, reversing valve 132 reverses the direction of refrigerant flow through sealed system 120. Thus, in the heating mode, indoor coil 124 is disposed downstream of compressor 122 and acts as a condenser, e.g., such that indoor coil 124 is operable to reject heat into the interior atmosphere 104 at indoor module 112 of saddle window air conditioner 100. In addition, outdoor coil 126 is disposed downstream of capillary tube 128 in the heating mode and acts as an evaporator, e.g., such that outdoor coil 126 is operable to heat refrigerant within outdoor coil 126 with energy from the exterior atmosphere at outdoor module 114 of saddle window air conditioner 100.

Indoor coil 124 and indoor fan 150 may be positioned within indoor module 112. Conversely, compressor 122, outdoor coil 126, reversing valve 132 and outdoor fan 148 may be positioned within outdoor module 114. In such a manner, certain noisy components of sealed system 120 may be spaced from the interior atmosphere 104, and saddle window air conditioner 100 may operate quietly. Various fluid passages, such as refrigerant conduits, liquid runoff conduits, etc., may extend through bridge 130 to fluidly connect components within indoor and outdoor modules 112, 114.

It should be understood that sealed system 120 described above is provided by way of example only. In alternative example embodiments, sealed system 120 may include any suitable components for heating and/or cooling air with a refrigerant. Sealed system 120 may also have any suitable arrangement or configuration of components for heating and/or cooling air with a refrigerant in alternative example embodiments.

As shown in FIG. 3, saddle window air conditioner 100 also includes a drain pan or bottom tray 138. Components of sealed system 120 within indoor module 112 are positioned on bottom tray 138. Thus, liquid runoff from components of sealed system 120 within indoor module 112 may flow into and collect within bottom tray 138. In particular, indoor coil 124 may be positioned over bottom tray 138 along the vertical direction V, and liquid runoff from indoor coil 124, e.g., generated during a defrost of indoor coil 124, may flow downwardly from indoor coil 124 into bottom tray 138. Thus, bottom tray 138 may collect defrost melt water from indoor coil 124 within indoor module 112. As discussed in greater detail below, saddle window air conditioner 100 may also include features for flowing the liquid runoff in bottom tray 138 out of indoor module 112, e.g., and to outdoor module 114.

As shown in FIG. 3, saddle window air conditioner 100 may also include a pump 142 and a float switch 144. Pump 142 is coupled to condensate tube 140 and is operable to flow the liquid runoff from indoor coil 124 within bottom tray 138 to outdoor module 114 through condensate tube 140. Float switch 144 is coupled to pump 142 and is operable to activate/deactivate pump 142 in response to a fill level of liquid runoff from indoor coil 124. For example, float switch 144 may be positioned within bottom tray 138, and liquid runoff from indoor coil 124 may flow into bottom tray 138 with float switch 144. As bottom tray 138 fills with liquid runoff from indoor coil 124, float switch 144 trips and activates pump 142 when bottom tray 138 is filled with a predetermined fill level of liquid runoff. In such a manner, liquid runoff from indoor coil 124 may be evacuated from bottom tray 138 by pump 142 when triggered by float switch 144.

Figure 4:
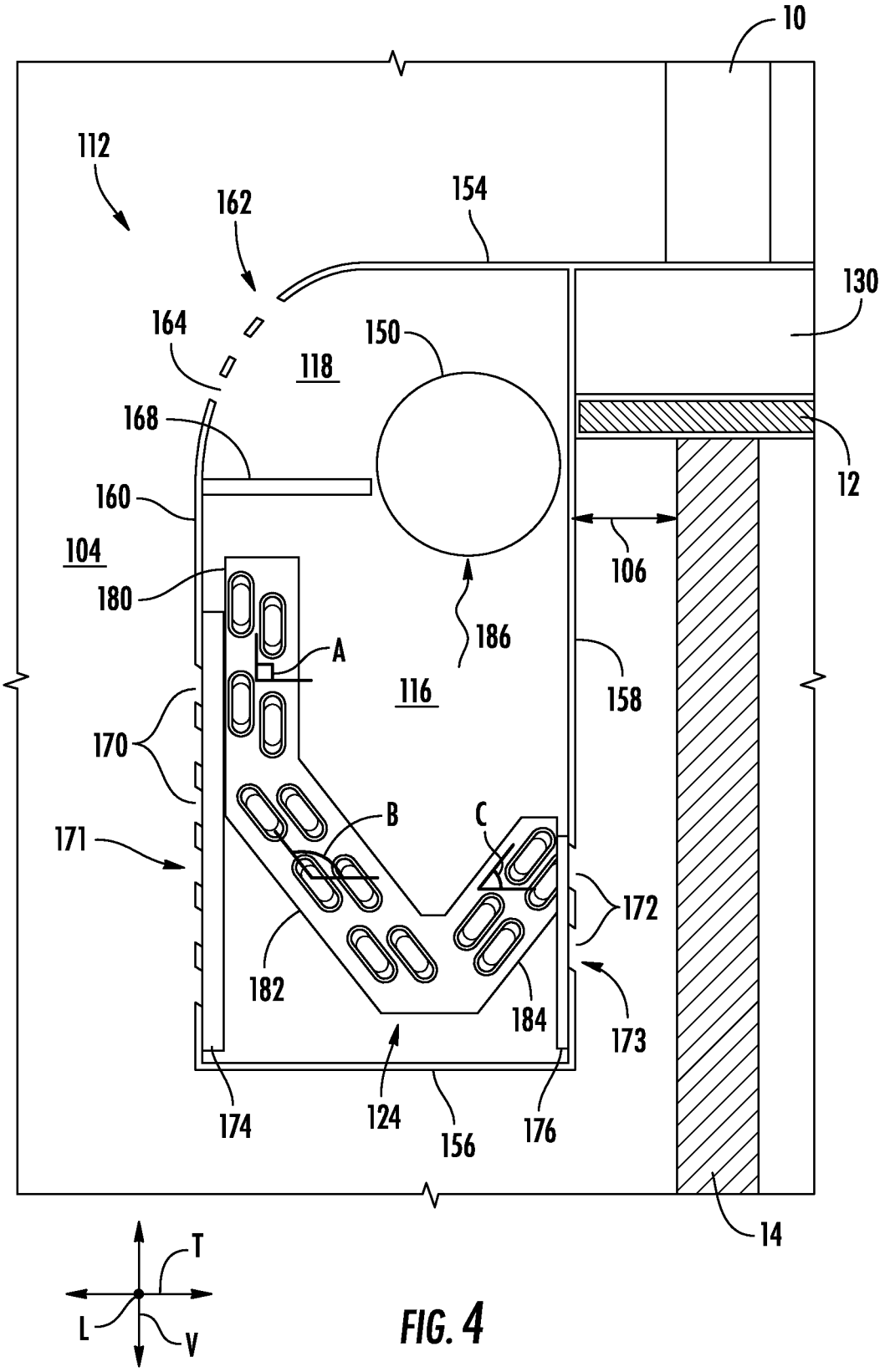
FIG. 4 provides a sectional view of the saddle window air conditioner of FIG. 2 taken along IV-IV.

FIG. 4 is illustrative of a cross sectional view of the indoor module 112 taken along line IV-IV in FIG. 2. Indoor module 112 includes a front wall 160 spaced apart and generally parallel to rear wall 158. Bottom wall 156 spans the distance between front and rear walls 160, 158 and connects the vertically lower ends of the front and rear walls 160, 158. Top wall 154 is generally parallel to, and spaced vertically above, bottom wall 156. An upper portion of front wall 160 may include a transition area to join the front and top walls 160, 154. In the illustrative embodiment of FIG. 4, front wall 160 includes an arcuate transition area 162, connecting a vertically upper portion of front wall 160 with top wall 154. In other embodiments, the transition between the front wall 160 and top wall 154 may be of other configurations, for example, the transition may be a square corner, or substantially a square corner.

Walls 154, 156, 158, and 160 define a chamber within indoor module 112. A baffle 168 cooperates with transversely adjacent indoor fan 150 to separate, at least partially, an upper portion or plenum 118 of the chamber from a lower portion, mixing zone 116. As illustrated, portions of the front wall, rear wall, bottom wall and baffle at least partially define the mixing zone 116. Plenum 118 is at least partially defined by the top wall 154, a portion of the front wall 160, and a portion of the rear wall 158. As with the mixing zone 116, baffle 168 and indoor fan 150 cooperate to partially define plenum 118. The plenum 118 is in fluid communication with interior atmosphere 104 through supply vent 164.

As illustrated, indoor module 112 supports indoor fan 150 at a vertically upper portion to urge a flow of air through the mixing zone 116 and the plenum 118. Indoor fan 150 may be any suitable fan to provide such an air flow, for example a cross-flow fan. The controller (not shown) is in operative communication with indoor fan 150 to selectively activate the indoor fan 150 in response to user inputs or other control signals. The controller may activate the indoor fan 150 in sequence with the operation of sealed system 120. When activated, indoor fan 150 urges an air flow by creating a negative pressure in mixing zone 116, drawing interior atmosphere 104 through front-side air intake 170 and rear-side air intake 172. Front-side air intake 170 and rear-side air intake 172 are in fluid communication with interior atmosphere 104. For clarity, the rear-side air intake 172 is spaced apart from wall 14 by the transverse (T) aspect of the sill 12. This space provides fluid communication between the rear-side air intake 172 and the interior atmosphere 104. In applications with sill 12 providing an inadequate space between rear wall 158 and wall 14, spacers (not shown) may be used to maintain an adequate distance between rear wall 158 and wall 14.

In some embodiments, a first filter 174 may be removable attached to the indoor module 112 at the front-side air intake to prevent debris carried by the interior atmosphere 104 from entering the indoor coils 124 and being carried into mixing chamber 116. Similarly, a second filter 176 may be removable attached to the indoor module 112 at the rear-side air intake, providing the same benefit.

As indoor fan 150 draws interior atmosphere 104 through the front-side and rear-side air intakes 170, 172 the flow of air is first directed over indoor coil 124. Increased surface area may beneficially be achieved by forming indoor coil 124 from a plurality of segments or coil portions at different angular orientations. In embodiments, indoor coil 124 comprises a plurality of coil portions that may be fluidly coupled to each other, as well as fluidly coupled to compressor 122 and outdoor coil 126. Each of the plurality of coil portions may be arranged at different angular orientation to a reference, for example the transverse direction T.

In the illustrative embodiment of FIG. 4, indoor coil 124 comprises three coil portions, first coil portion 180, second coil portion 182, and third coil portion 184, each coil portion positioned in a different angular orientation. For example, first coil portion 180 is generally parallel to front wall 160 and front-side air intake 170 (i.e., generally perpendicular (at right angle A) to the transverse T direction). Second coil portion 182 is arranged at a generally obtuse angle B to the transverse T direction measured in a counterclockwise direction. Alternately described, the centerline of second coil portion 182 is at an angle measured from the centerline of first coil portion 180 of more than 90° but less than 180° in the clockwise direction. Third coil portion 184 is arranged or positioned at a generally acute angle C to the transverse T direction measured in a counterclockwise direction. Alternately described, third coil portion 184 and second coil portion 182 (i.e., an angle formed between centerlines of the second and third coil portions 182, 184 is between 0° and 90°). Third coil portion 184 is also positioned to form an acute angle to the bottom wall 156 and rear-side air intake 172.

As is generally understood, first, second, and third coil portions 180, 182, 184 arranged as described above and illustrated in at least FIG. 4 provide a greater linear length, and consequently a greater surface area, than a single planar coil configuration. Three coil portions are shown for ease of illustration with the understanding that fewer coil portions (e.g., two) or more coil portions (e.g., 4 or more) could also be used in other embodiments. Also from the configuration described above and illustrated, multiple air flow paths may be realized as the interior atmosphere 104 can flow in multiple directions over coil portions.

In the illustrated configuration of FIG. 4, the air flow over the indoor coil 124 is comprised of two air flows, each from a different source. A first air flow 171 is urged by indoor fan 150 over the coil 124 comes from the front-side air intake 170. Mixing zone 116 is in fluid communication with interior atmosphere 104 through at least the front-side air intake 170.

As second air flow 173 over indoor coil 124 comes from the rear-side air intake 172, drawing interior atmosphere 104 from the space 106 between rear wall 158 and wall 14. This second air flow 173 enters the indoor module 112 substantially opposite to the flow direction of the first air flow 171 through the front-side air intake 170. First air flow 171 passes at least partially across each of first and second coil portions 180, 182. Second air flow beneficially does not pass through first or second coil portions 180, 182. Instead, second air flow 173 passes only, or at least substantially, over third coil portion 184 and is not opposing the first air flow 171. In embodiments having fewer or more coil portions, fewer or more air flows may be realized.

Once the first and second air flows 171, 173 pass over the coil 124, the two airflows 171, 173 mix in mixing zone 116 and form a combined air flow 186. Combined air flow 186 is drawn into indoor fan 150 and urged into plenum 118. As the fan continues to draw combined air flow 186 into plenum 118, the pressure within plenum 118 increases. The pressurized air is urged to exit plenum 118 through supply vent 164. Supply vent 164 is in fluid communication with interior atmosphere 104 allowing the pressurized flow of the combined air flows to pass through.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A saddle window air conditioner defining a horizontal direction, a vertical direction, and a transverse direction, the saddle window air conditioner comprising:

an indoor module and an outdoor module spaced apart from each other and defining a gap;

a bridge extending across the gap from the indoor module to the outdoor module, the bridge configured to support the indoor module and the outdoor module on a windowsill, the bridge configured to house one or more fluid conduits extending between the indoor module and the outdoor module;

wherein the indoor module comprises:

a front-side air intake;

a rear-side air intake;

an indoor coil formed of a plurality of coil portions, the plurality of coil portions integrally formed together as a single piece, the plurality of coil portions extending linearly in different directions;

a fan configured to urge a flow of air over the indoor coil;

a front wall; and a baffle extending linearly between the front wall and the fan, wherein:

each of the plurality of coil portions is arranged at a different angular orientation; and the plurality of coil portions are positioned entirely on one side of the fan.

2. The saddle window air conditioner of claim 1, wherein the flow of air over the indoor coil comprises a first air flow from the front-side air intake and a second air flow from the rear-side air intake.

3. The saddle window air conditioner of claim 2, wherein the indoor module comprises:

a rear wall spaced apart from the front wall;

a top wall connected to an upper end of the front wall and an upper end of the rear wall;

a bottom wall connected to a lower end of the front wall and a lower end of the rear wall; and wherein the front wall, the rear wall, the bottom wall, and the baffle at least partially define a mixing zone; and the first air flow and the second air flow form a combined air flow in the mixing zone.

4. The saddle window air conditioner of claim 3, wherein the top wall, a portion of front wall, a portion of the rear wall, and the baffle define a plenum.

5. The saddle window air conditioner of claim 4, wherein the fan further urges the combined air flow to the plenum.

6. The saddle window air conditioner of claim 5, wherein the plenum is in fluid communication with an interior atmosphere through a supply vent.

7. The saddle window air conditioner of claim 2, wherein each of the plurality of coil portions is fluidly coupled to each other and to a compressor.

8. The saddle window air conditioner of claim 7, wherein the indoor coil comprises three coil portions.

9. The saddle window air conditioner of claim 8, wherein a first coil portion is generally perpendicular to the transverse direction.

10. The saddle window air conditioner of claim 9, wherein the first air flow is at least partially over the first coil portion.

11. The saddle window air conditioner of claim 8, wherein;

a first coil portion is generally perpendicular to the transverse direction; and a second coil portion is positioned at a generally obtuse angle to the transverse direction whereby the obtuse angle is an angle defined between a centerline of the first coil portion and a centerline of the second coil portion that is greater than 90 degrees and less than 180 degrees.

12. The saddle window air conditioner of claim 11, wherein the first air flow is at least partially over the second coil portion.

13. The saddle window air conditioner of claim 8, wherein:

a first coil portion is generally perpendicular to the transverse direction;

a second coil portion is positioned at a generally obtuse angle to the transverse direction whereby the obtuse angle is an angle defined between a centerline of the first coil portion and a centerline of the second coil portion that is greater than 90 degrees and less than 180 degrees; and a third coil portion is positioned at an acute angle to the transverse direction whereby the acute angle is an angle defined between the centerline of the second coil portion and a centerline of the third coil portion that is greater than 0 degrees and less than 90 degrees.

14. The saddle window air conditioner of claim 8, wherein the second air flow is over a third coil portion.

15. The saddle window air conditioner of claim 1, wherein the indoor module further comprises:

a first filter removably attached to the indoor module at the front-side air intake; and a second filter removably attached to the indoor module at the rear-side air intake.

16. The saddle window air conditioner of claim 1, wherein the fan is a cross-flow fan.

17. A saddle window air conditioner defining a horizontal direction, a vertical direction, and a transverse direction, the saddle window air conditioner comprising:

an indoor module comprising:

a front-side air intake;

a rear-side air intake;

an indoor coil formed of a plurality of coil portions, the plurality of coil portions integrally formed together as a single piece, the plurality of coil portions extending linearly in different directions and arranged at a different angular orientation;

an indoor fan;

a front wall; and a baffle extending linearly between the front wall and the indoor fan;

an outdoor module spaced apart from the indoor module such that a gap is defined between the indoor module and the outdoor module, the outdoor module comprising:

an outdoor coil;

a compressor; and a reversing valve; and a bridge extending across the gap from the indoor module to the outdoor module, the bridge configured to support the indoor module and the outdoor module on a windowsill, the bridge configured to house one or more fluid conduits extending between the indoor module and the outdoor module, wherein:

the indoor coil is an evaporator when the reversing valve is in a first position and the indoor coil is a condenser when the reversing valve is in a second position; and the plurality of coil portions of the indoor coil are positioned entirely on one side of the indoor fan.

18. The saddle window air conditioner of claim 17 wherein the indoor fan urges a flow of air over the indoor coil, the flow of air over the indoor coil comprising a first air flow from the front-side air intake and a second air flow from the rear-side air intake.

19. The saddle window air conditioner of claim 18, wherein the indoor module further comprises:

a rear wall spaced apart from the front wall;

a top wall connected to an upper end of the front wall and an upper end of the rear wall;

a bottom wall connected to a lower end of the front wall and a lower end of the rear wall; and wherein the front wall, the rear wall, the bottom wall and the baffle at least partially define a mixing zone; and wherein the first air flow and the second air flow form a combined air flow in the mixing zone.

20. The saddle window air conditioner of claim 19 wherein the first air flow and the second air flow are cooled when the reversing valve is in the first position and the first air flow and the second air flow are warmed when the reversing valve in in the second position.

* * * * *